US006790259B2

(12) United States Patent
Rittri et al.

(10) Patent No.: US 6,790,259 B2
(45) Date of Patent: Sep. 14, 2004

(54) METHOD AND DEVICE FOR CLEANING A GASEOUS FLUID USING A CONDUCTIVE GRID BETWEEN CHARGING HEAD AND FILTER

(75) Inventors: Bengt Rittri, Stockholm (SE); Johan Wennerstrom, Sollentuna (SE)

(73) Assignee: Blueair AB, Stockholm (SE)

( * ) Notice: Subject to any disclaimer, the term of this patent is extended or adjusted under 35 U.S.C. 154(b) by 0 days.

(21) Appl. No.: 10/345,585

(22) Filed: Jan. 16, 2003

(65) Prior Publication Data

US 2004/0139854 A1 Jul. 22, 2004

(51) Int. Cl.[7] ..... B03C 3/155

(52) U.S. Cl. ..... 95/78; 95/79; 96/66; 96/77; 96/97

(58) Field of Search ..... 96/97, 96, 77, 96/64, 66; 95/78, 79; 55/528

(56) References Cited

U.S. PATENT DOCUMENTS

| | | | | | |
|---|---|---|---|---|---|
| 3,999,964 | A | * | 12/1976 | Carr | 96/59 |
| 5,330,559 | A | * | 7/1994 | Cheney et al. | 95/63 |
| 5,403,383 | A | * | 4/1995 | Jaisinghani | 95/69 |
| 5,407,469 | A | * | 4/1995 | Sun | 96/62 |
| 5,474,600 | A | * | 12/1995 | Volodina et al. | 96/57 |
| 5,484,472 | A | * | 1/1996 | Weinberg | 96/26 |
| 5,518,531 | A | * | 5/1996 | Joannu | 96/55 |
| 5,573,577 | A | * | 11/1996 | Joannou | 96/66 |
| 5,593,476 | A | * | 1/1997 | Coppom | 95/78 |
| 5,807,425 | A | * | 9/1998 | Gibbs | 96/66 |
| 5,906,677 | A | * | 5/1999 | Dudley | 96/17 |
| 6,251,171 | B1 | * | 6/2001 | Marra et al. | 96/69 |
| 6,364,935 | B1 | * | 4/2002 | Wennerstrom | 95/57 |

FOREIGN PATENT DOCUMENTS

| | | | |
|---|---|---|---|
| JP | 54-11571 | * | 1/1979 |

* cited by examiner

*Primary Examiner*—Richard L. Chiesa
(74) *Attorney, Agent, or Firm*—Chapman and Cutler LLP

(57) ABSTRACT

An improved method is disclosed for cleaning a flow of gaseous fluid, such as room air, from particles present in the fluid, the gaseous fluid being ionized, and using a conductive grid placed across and upstream of the filter for protecting the filter from being charged by free ions. An air purifier filter cartridge using the ion-intercepting grid of the invention is also disclosed. The grid may be connected to or electrically insulated from the ionizer ground potential, with equal effect.

12 Claims, 1 Drawing Sheet

METHOD AND DEVICE FOR CLEANING A GASEOUS FLUID USING A CONDUCTIVE GRID BETWEEN CHARGING HEAD AND FILTER

BACKGROUND OF THE INVENTION

1. Field of the Invention

The invention relates to methods and devices for cleaning a gaseous fluid of particles present in said fluid, particularly where the fluid is ionized and then filtered.

2. Prior Art

Swedish patent no. A-9604817-8 discloses a device using an active electret filter. An electric field is directed towards the precipitator unit that consists of medium being electrically non-conductive and whose molecules are easily polarized or oriented by an electric field directed towards the precipitator unit. An electric field is created inside the fiber material comprising the precipitator unit. The particles that pass into the filter medium, being first charged by the ionization unit, are attracted by the filter fibers regardless of the charge polarity of any particular fiber and particle, as each fiber and each particle has spaced-apart positive and negative charges thereon.

U.S. Pat. No. 6,364,935, issued Apr. 2, 2002, to the present inventor, discloses and claims an advanced HEPA filter using polypropylene filter media to attract and capture ionized particles from a gaseous stream, as of household or office air. The arrangement normally provides superior filtering performance, but where the incoming fluid stream is very clean it sometimes happens, as the present inventor has discovered, that ions not bound to particles will impinge on the filter media and themselves charge the media fibers, reducing filter performance by the ions' repelling, rather than attracting, charged particles in the fluid stream.

Coppom U.S. Pat. No. 5,593,476 shows in FIG. 1 a pre-charging grid 32 and an insulated-wire electrode grid 34 upstream of a polypropylene or other filter 36, and a grounded carbon electrode grid 42 downstream of the filter 36. Power source 48 is attached between the grids 32 and 42. FIG. 2 shows a system in which both upstream grids are charged negatively and the downstream grid is charged positively, thus polarizing the filter media, subject to migration of charges back to the grids. Examples of filter efficiency are shown both with and without ionization.

Gibbs U.S. Pat. No. 5,807,425 shows a charged grid 3 located between two filter mats 1 and 2, which may be of polypropylene. Non-conductive screens 8 and 9 outside the filter mats simply hold the mats in place. Charging of the grid 3 polarizes the filter media, for attracting and holding particles in the media due to their natural polarities—no ionization is imparted to them upstream of the filter media.

Dudley U.S. Pat. No. 5,906,677 shows a passive, electrostatic "supercharging" screen 10 located downstream of a filter 14. The screen comprises a thin, fine mesh layer 32 of polypropylene that is supported by metal mesh material 36 on either side. The screen 10 is said to remove fine particles not removed by the conventional filter 14. No ionization is provided.

SUMMARY OF THE INVENTION

A flat, open grid or mesh of conductive material is positioned on the upstream side of a pleated polypropylene filter medium, as a first element in a replaceable filter box or cartridge used in an ionizing air cleaner. The grid is not insulated from contact with passing air or the filter medium. The grid is grounded to the charging system in a drain form of the invention, or alternatively it is not so grounded, in a shield form. The effect of either form is to avoid polarization of the filter medium by ions in the air stream that are not attached to particles to be removed from the air stream. A 20–30% increase in filter efficiency is seen when the grid is added onto a filter box or cartridge in this arrangement.

BRIEF DESCRIPTION OF THE DRAWING

The one drawing FIGURE shows a schematic view of a device according to the invention, with a dotted line showing optional grounding of the protective, conductive grid.

DETAILED DESCRIPTION OF THE PREFERRED EMBODIMENTS

Figure 1:
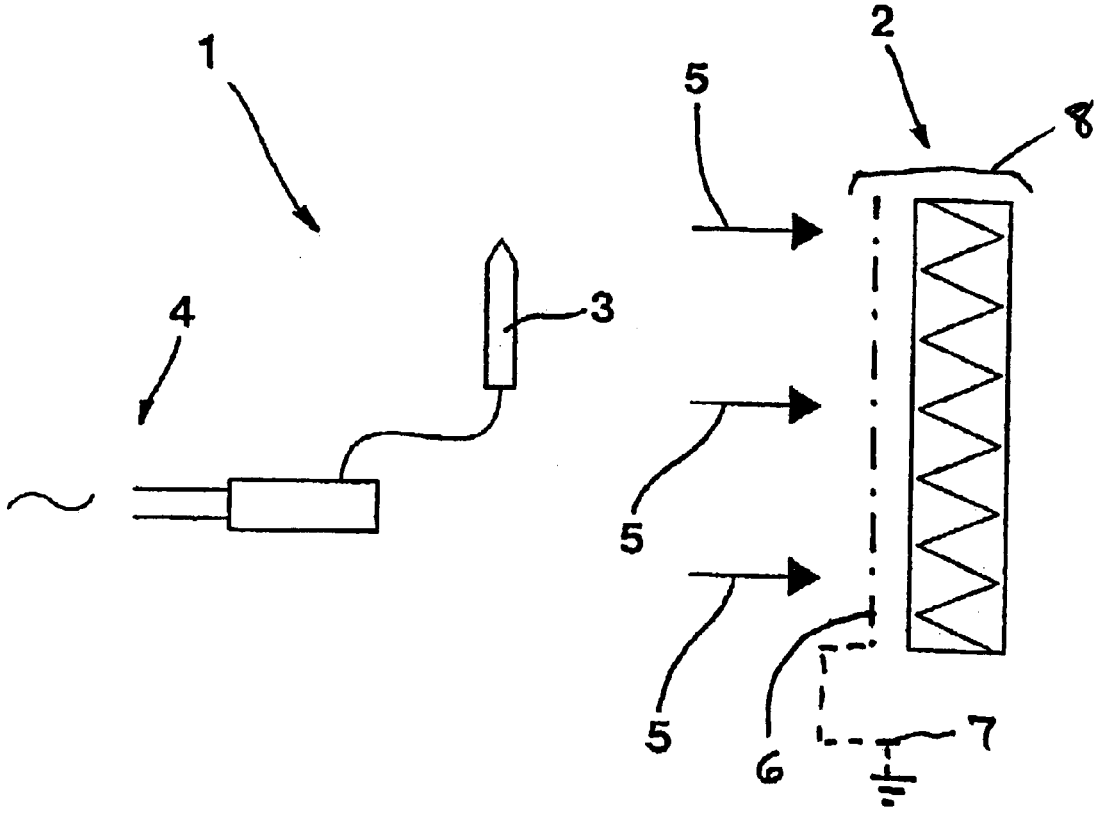

An ionization unit 1 includes a corona tip 3 connected to a high voltage source 4. Other types of corona tips are known and may be used, for instance a coal fiber brush or a corona wire. The device also includes a downstream filter or precipitator unit 2 described more in detail below.

The ionization unit 1 does not need to be located adjacent the precipitator unit 2 but it may in principle be located anywhere in the space that contains the gaseous fluid to be cleaned by the method and the device of the present invention.

The precipitator unit 2 consists of a filter of an electrically non-conductive medium, preferably a fiber filter of polypropylene. It is advantageous if the filter medium has fibers with fiber diameters down to 1 micron and less. The density of or spacing among the fibers is not critical but may be on the order of 5 to 15 times the fiber diameter. Air velocity through the filter medium is preferably 2–10 centimeters per second.

The fibers of the filter medium are not pre-charged but are charged only by the ions generated in the ionization unit 1. That is, particles in the air stream are charged by the ions clinging to them and then transfer such ionic charges to the fibers in the filter medium 2 when the particles contact and adhere to them. The present invention preferably does not constitute an electret filter. It is also advantageous if the polypropylene fibers are untreated.

In accordance with the present invention, an open mesh or grid 6 of conductive material is placed across the flow of air 5 between the ionizer 1 and the filter 2. The conductive material can be metal, as tin or aluminum, conductive carbon fiber, or the like. In one form, the mesh or grid is made of expanded metal sheet, with diamond-shaped grid openings of about 0.65 cm in one direction and about 1.3 cm in the other, the grid comprising members about 0.8 mm across between lands at the points of the diamonds. The grid optionally may be grounded in the device, as by a connection at 7, for draining charge from the grid. In one form where the grid 6 is not connected to ground, the grid is provided adjacent and in contact with the upstream side of the filter media, packed as part of a replacement filter cartridge 8 having a cardboard outer container open at the two large sides for passage of the air and particulate matter.

The device according to the invention functions in the following way. In an air purifier, the ionization unit 1 is located in a flow 5 of the gaseous fluid, normally air, which contains particles to be removed. The flow 5 of air is normally caused by a fan, not shown. Particles in the air are charged by ions created and emitted by the ionization unit 1. Particles so charged pass to the precipitator unit 2 with the air flow 5. When these particles hit the fibers of the filler medium, then the molecules of the fibers are polarized by the charges on the particles, as noted in the prior U.S. Pat. No. 6,364,935.

Adding the grid 6 to the filter 2, upstream of the filter media, has been found to greatly improve the filtering performance of the entire system. The following shows the performance of a filter operating at a face velocity of 0.87 meters per second, without a conductive grid of any kind:

| NO GRID Particle size, μm | Particles Downstream of filter | Particles Upstream of filter | Efficiency, % |
|---|---|---|---|
| 0.3–0.5 | 18962 | 114418 | 83.4 |
| 0.5–0.7 | 985 | 8489 | 88.4 |
| 0.7–1.0 | 148 | 1680 | 91.2 |
| 1.0–5.0 | 21 | 699 | 97.0 |
| >5 | 0 | 7 | 100.0 |

In contrast, when a conductive grid as described above is added adjacent the upstream side of the filter, as part of the filter cartridge, the following improved particulate filtering performance is realized:

| WITH GRID Particle size, μm | Particles Downstream of filter | Particles Upstream of filter | Efficiency, % |
|---|---|---|---|
| 0.3–0.5 | 18882 | 126438 | 90.6 |
| 0.5–0.7 | 759 | 9618 | 92.1 |
| 0.7–1.0 | 134 | 1865 | 92.8 |
| 1.0–5.0 | 25 | 868 | 97.1 |
| >5 | 0 | 21 | 100.0 |

The following chart compares air purifier performance without and with an ungrounded grid in place:

| COMPARISON Particle size, μm | NO GRID Efficiency, % | WITH GRID Efficiency, % | Change in Efficiency, % |
|---|---|---|---|
| 0.3–0.5 | 83.4 | 90.6 | +7.2 |
| 0.5–0.7 | 88.4 | 92.1 | +3.7 |
| 0.7–1.0 | 91.2 | 92.8 | +.6 |
| 1.0–5.0 | 97.0 | 97.1 | +.1 |
| >5 | 100.0 | 100.0 | 0 |

Although the increases in filter efficiency in each particle size range may seem numerically small, in effect they are quite significant. First, a greater number of the small particles are removed by the more efficient filter system with the conductive grid. Second, to obtain by conventional methods the improved performance provided by the grid would require much thicker filter media, making the filter both larger and much more expensive. To improve from 83.4% efficiency to 90.6% efficiency, as is effected by the metal grid of this invention for particles 0.3 to 0.5 microns in size, would require for instance that a conventional filter be increased in its thickness and mass by nearly 50%.

The invention is disclosed in a preferred form but may be practiced in various ways without departing from the principles disclosed and discussed. The invention is to be defined and limited only by the appended claims.

What is claimed is:

1. In a device for removing particles from a flow of gaseous fluid, the device comprising, one of a continuously positive and a continuously negative high voltage source exposed within the flow of the gaseous fluid;

a filter spaced apart from said high voltage source, said filter comprising a fine filter medium comprising fibers of untreated polypropylene, each fiber having a diameter on the order of approximately one micron and the average spacing between the fibers in the filter being about five to fifteen times the filter diameter, and said fibers being easily polarized when subjected to an electric charge; and said filter having no charging means other than said particles contacting said filter in said flow, the improvement wherein the device further comprises:

an electrically-conductive, gas- and particle-pervious screen or grid extending across said fluid flow in the space between the high voltage source and the filter, whereby to improve the efficiency of the filter in removing said particles from said fluid flow by removing free ions from the fluid flow.

2. The improved device as defined in claim 1, wherein said fluid flow past said high voltage source has a velocity between 2 and 10 cm per second.

3. The improved device as defined in claim 1, wherein said high voltage source comprises a corona discharge means.

4. The improved device as defined in claim 1, wherein said high voltage source comprises a carbon fiber brush.

5. The improved device as defined in claim 1, wherein said grid or mesh is electrically grounded.

6. The improved device as defined in claim 1, wherein said grid or mesh is electrically isolated.

7. An improved method for cleaning a flow of gaseous fluid of particles present in said fluid, comprising the steps of:

providing a high voltage source of continuous polarity for providing ions into said flow;

setting a fine filter medium displaced from said source, said fine filter medium being comprised of electrically non-conductive fibers comprising untreated polypropylene, each fiber having a diameter on the order of approximately one micron and an average spacing among them of five to fifteen times the fiber diameter;

setting an electrically-conductive grid substantially entirely across said flow between the voltage source and the filter medium, the grid being permeable to said flow and said particles;

passing said fluid past said high voltage source, thereby charging said particles either positively or negatively without alternating between positive and negative charges;

passing said charged particles through said grid and then through said filter medium, thereby removing free ions from the fluid onto the grid and avoiding effectively polarizing said fibers into a positive side and a negative side thereof without any net change in polarity of said fibers during said cleaning of said fluid; and adhering said charged particles to an oppositely-charged side of said fibers, said fibers being charged solely by said particles.

8. The improved method as defined in claim 7, wherein said grid is electrically grounded, for passing charges from said free ions to the ground.

9. The improved method as defined in claim 7, wherein said grid is electrically isolated.

10. An improved filter cartridge for an ionizing room air purifier which creates an air flow through the purifier, the cartridge comprising:

an electrically nonconductive, fibrous filter media having two opposed faces, the fibrous filter media being comprised of untreated polypropylene fibers having average diameters on the order of about one micron, and the spacing among the fibers being five to fifteen times the fiber diameters;

a container enclosing said media except at a path for said air flow through said media, from one face to the other; and an electrically conductive grid placed against one face of the filter media and held there by said container for use during filtering operation, whereby the grid may be placed in the flow to intercept ions not affixed to particles in the air flow, to reduce charging of the filter media by such ions.

11. The improved filter cartridge of claim 10, wherein the cartridge includes means electrically connecting the grid to an electrical ground in the purifier.

12. The improved filter cartridge of claim 10, wherein the cartridge includes means electrically insulating the grid from any electrical ground in the purifier.

* * * * *